US005154636A

United States Patent [19]

Vaccaro et al.

[11] Patent Number: 5,154,636

[45] Date of Patent: Oct. 13, 1992

[54] SELF-FLARING CONNECTOR FOR COAXIAL CABLE HAVING A HELICALLY CORRUGATED OUTER CONDUCTOR

[75] Inventors: Ronald A. Vaccaro, Orland Park; John J. Meares, Hometown; Gary E. Frigo, Frankfort, all of Ill.

[73] Assignee: Andrew Corporation, Orland Park, Ill.

[21] Appl. No.: 641,521

[22] Filed: Jan. 15, 1991

[51] Int. Cl.[5] ..... H01R 17/04

[52] U.S. Cl. ..... 439/583; 439/578

[58] Field of Search ..... 439/578-585, 439/675

[56] References Cited

U.S. PATENT DOCUMENTS

| | | | |
|---|---|---|---|
| 3,199,061 | 8/1965 | Johnson et al. | 439/583 |
| 3,678,446 | 7/1972 | Siebelist | 439/583 |
| 4,046,451 | 9/1977 | Juds et al. | 439/583 |
| 4,047,291 | 9/1977 | Spinner | 439/578 |
| 4,408,822 | 10/1983 | Nikitas | 439/583 |
| 4,687,272 | 8/1987 | Spinner et al. | 439/583 |

FOREIGN PATENT DOCUMENTS

| | | | |
|---|---|---|---|
| 900393 | 7/1962 | United Kingdom | 439/583 |

*Primary Examiner*—David L. Pirlot

*Attorney, Agent, or Firm*—Arnold, White & Durkee

[57] ABSTRACT

A connector assembly for a coaxial cable having a helically corrugated outer conductor has a unitary clamping member with a threaded inner surface to match the helical corrugations of the outer conductor of the coaxial cable so that the clamping member can be threaded onto the helically corrugated outer conductor. The end of the clamping member is beveled so as to slope inwardly toward the threaded inner surface of the clamping member. A flaring ring, having an inside diameter at least as small as the inside diameter of the helically corrugated outer conductor, has a bevelled end which engages the inner surface of the open end of the outer conductor so as to flare the engaged portion of the outer conductor outwardly. A body member and the clamping member have integral telescoping sleeves with cooperating threaded surfaces which draw and hold the bevelled ends of the flaring ring and the clamping member together against opposite surfaces of the outer conductor of the cable.

8 Claims, 4 Drawing Sheets

SELF-FLARING CONNECTOR FOR COAXIAL CABLE HAVING A HELICALLY CORRUGATED OUTER CONDUCTOR

FIELD OF THE INVENTION

The present invention relates generally to connectors for coaxial cables, and, more particularly, to connectors for coaxial cables having helically corrugated outer conductors.

BACKGROUND OF THE INVENTION

Connectors for coaxial cable having annularly or helically corrugated outer conductors are generally used throughout the semi-flexible coaxial cable industry. In Juds et al., U.S. Pat. No. 4,046,451, a connector for coaxial cables having annularly corrugated outer conductors is described. The connector has a flaring ring which pushes under one of the crests of the annularly corrugated outer conductor at the end of the cable. The flaring ring would not properly engage a helically corrugated outer conductor because the end of a helically corrugated conductor includes a corrugation root in addition to a corrugation crest. Moreover, the clamping member of the connector fits over the annularly corrugated conductor by applying an axial force to expand a plurality of longitudinal spring fingers, allowing internal beads on the outer ends of the spring fingers to engage a corrugation root. Such spring fingers are not suitable for a helically corrugated conductor because the roots of the corrugations follow a helical path along the length of the cable.

A connector for a coaxial cable having a helically corrugated outer conductor is described in Johnson et al., U.S. Pat. No. 3,199,061. The connector has a flaring ring with an inside diameter greater than the inside diameter of the outer conductor, and requires that the end of the outer conductor be flared manually with a pliers before the flaring ring is advanced against the outer conductor.

SUMMARY OF THE INVENTION

It is a primary object of the present invention to provide an improved connector for coaxial cables having helically corrugated outer conductors, which is easy to install, or to remove and re-install, particularly under field conditions.

It is another object of this invention to provide an improved connector which can be installed and removed without the use of any special tools and without any preliminary manual flaring of the outer conductor of the cable.

A further object of this invention is to provide an improved connector which has a minimum number of parts.

Still another object of this invention is to provide an improved connector which can be efficiently and economically manufactured.

A still further object of this invention is to provide an improved connector providing a superior junction between the helically corrugated outer conductor and the bevelled end of the flaring ring.

Other objects and advantages of the invention will be apparent from the following detailed description and the accompanying drawings.

In accordance with the present invention, the foregoing objectives are realized by providing a connector assembly for a coaxial cable having a helically corrugated outer conductor, the connector assembly having a unitary clamping member with a threaded inner surface to match the helical corrugations of the outer conductor of the coaxial cable so that the clamping member can be threaded onto the helically corrugated outer conductor. The end of the clamping member is beveled, sloping inwardly toward the threaded inner surface of the clamping member. A flaring ring has a bevelled end which engages the inner surface of the end of the outer conductor so as to flare the end of the outer conductor outwardly against the bevelled surface on the clamping member, when the flaring ring is advanced into the open end of the outer conductor. A body member and the clamping member have integral telescoping sleeves with cooperating threaded surfaces which draw and hold the bevelled surfaces of the flaring ring and the clamping member against opposite surfaces of the outer conductor of the cable to provide positive electrical contact.

To provide self-flaring of the outer conductor by the flaring ring, the inside diameter of the forward, conductor-engaging end of the flaring ring is at least as small as the inside diameter of the corrugated outer conductor. In the preferred embodiment, the inside diameter of the rear portion of the flaring ring is larger than the inside diameter of the outer conductor in order to minimize the effect on VSWR caused by the reduced inside diameter at the forward end of the flaring ring.

DESCRIPTION OF THE PREFERRED EMBODIMENT

Figure 1:
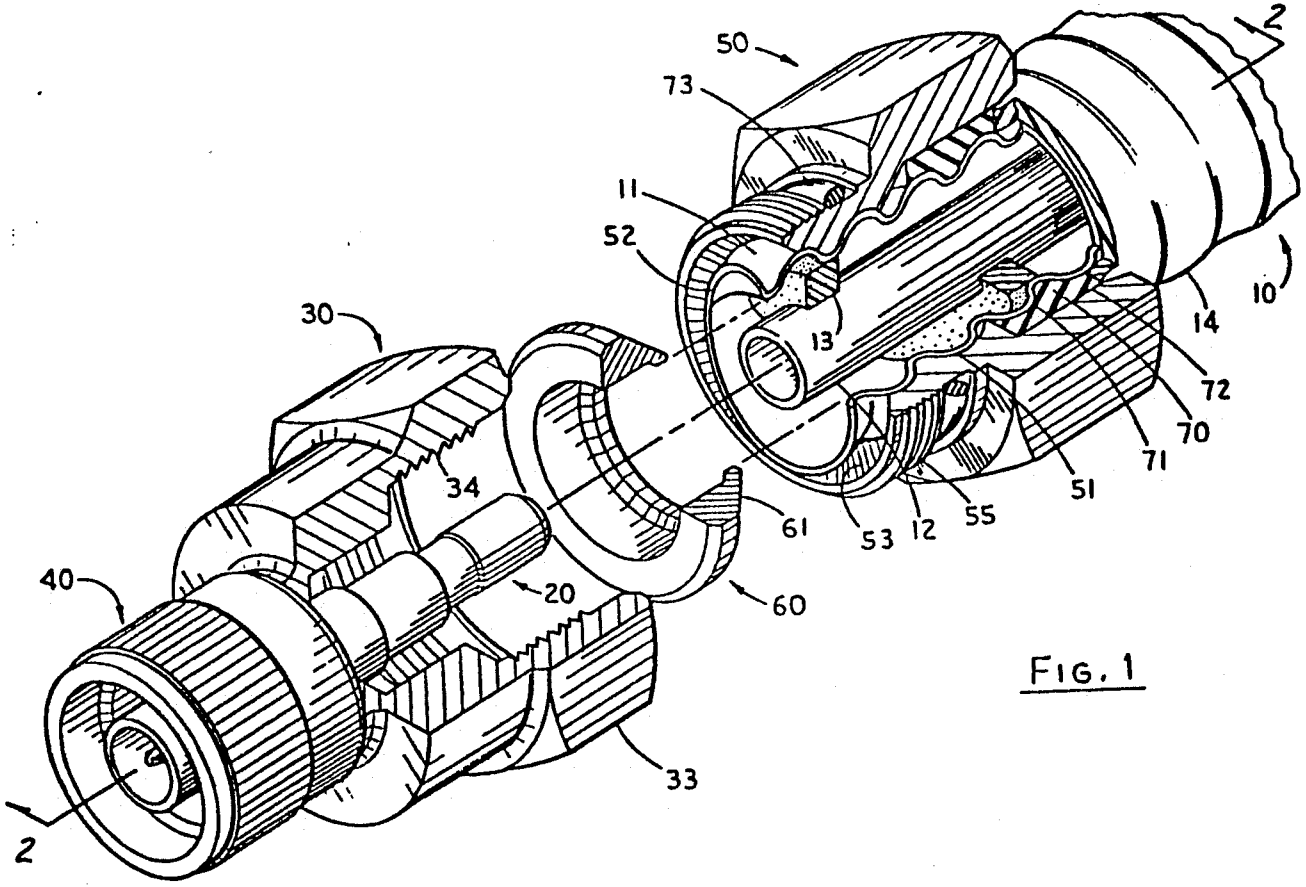
FIG. 1 is a perspective view of a connector embodying the present invention.

While the invention is susceptible to various modifications and alternative forms, a specific embodiment thereof has been shown by way of example in the drawings and will be described in detail. It should be understood, however, that it is not intended to limit the invention to the particular form described, but, on the contrary, the intention is to cover all modifications, equivalents, and alternatives falling within the spirit and scope of the invention as defined by the appended claims.

Turning now to the drawings, there is shown a connector assembly for a coaxial cable 10 having a helically corrugated outer conductor 11 concentrically spaced from a hollow inner conductor 12 by a dielectric spacer 13. As is well known to those familiar with the art, a helically corrugated conductor is distinguished from an annularly corrugated conductor in that the helical corrugations form a continuous pattern of corrugation crests and roots along the length of the cable such that each crest is opposite a root along the circumference of the conductor. Consequently, any transverse cross-section taken through the conductor perpendicular to its axis is radially asymmetrical, which is not true of annularly corrugated conductors.

To prepare the cable 10 for attachment of the connector assembly, the end of the cable is cut along a plane extending perpendicularly to the axis of the cable. Any burrs or rough edges on the cut end of the metal conductor are preferably removed to avoid interference with the connector. The outer surface of the outer conductor 11 is normally covered with a polymeric jacket 14 which is trimmed away from the end of the outer conductor 11 along a sufficient length to accommodate the connector assembly.

Electrical contact with the inner conductor 12 of the cable 10 is effected by a conventional connector element 20 forming a plurality of spring fingers 21 at its forward end to make electrical contact with the inside surface of the hollow inner conductor 12. The connector element 20 also includes an enlarged collar 22 and an elongated pin 23 for connecting the inner conductor 12 to a conventional complementary female member (not shown). An insulator 24 for centering the pin 2 within the main body member 30 of the connector assembly and for electrically isolating these two elements from each other is part of the connector element 20. It will be noted that the interior of the body member 30 includes a recess 31 for receiving the insulator 24, which is also conventional in the art of coaxial cable connectors.

The coupling nut 40 secured to the body member 30 around the pin 23 is also a conventional fitting, and is secured to the body member by a spring retaining ring 41 which holds the nut 40 captive on the body member 30 while permitting free rotation of the nut 40 on the member 30. As will be apparent from the ensuing description, this coupling nut 40 serves as a part of the electrical connection to the outer conductor of the cable 10, and is insulated from the inner conductor by the insulator 24 carried by the inner connector pin 23.

A clamping member 50 has a threaded inner surface 51 to match the helical corrugations of the outer conductor 11. Thus, the member 50 can be threaded onto the outer conductor until at least a major portion of a conically bevelled surface 53 on the end of the clamping member 50 overlaps the outer conductor 11. The conically bevelled surface 53 slopes inwardly toward the threaded inner surface 51 of the clamping member 50.

Figure 2:
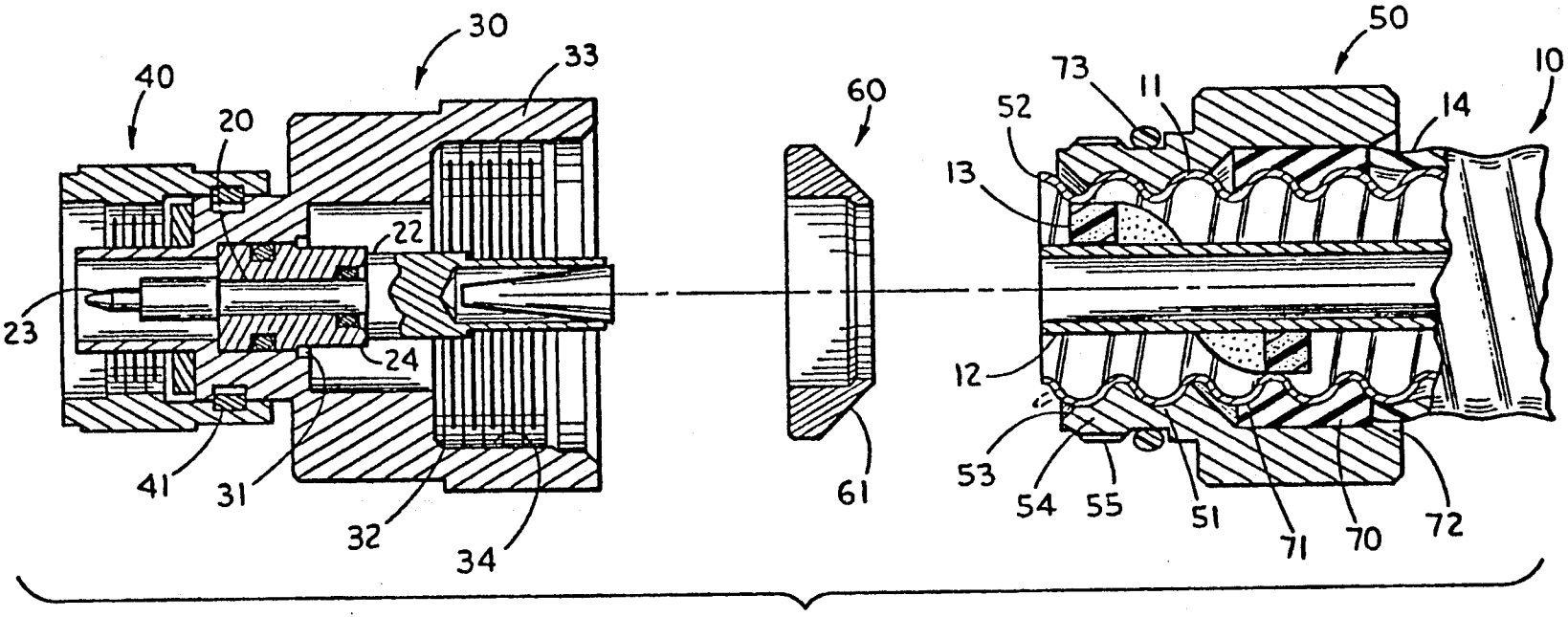
FIG. 2 is a longitudinal sectional view of the connector shown in FIG. 1 with only one of the parts attached to the coaxial cable.
Figure 3:
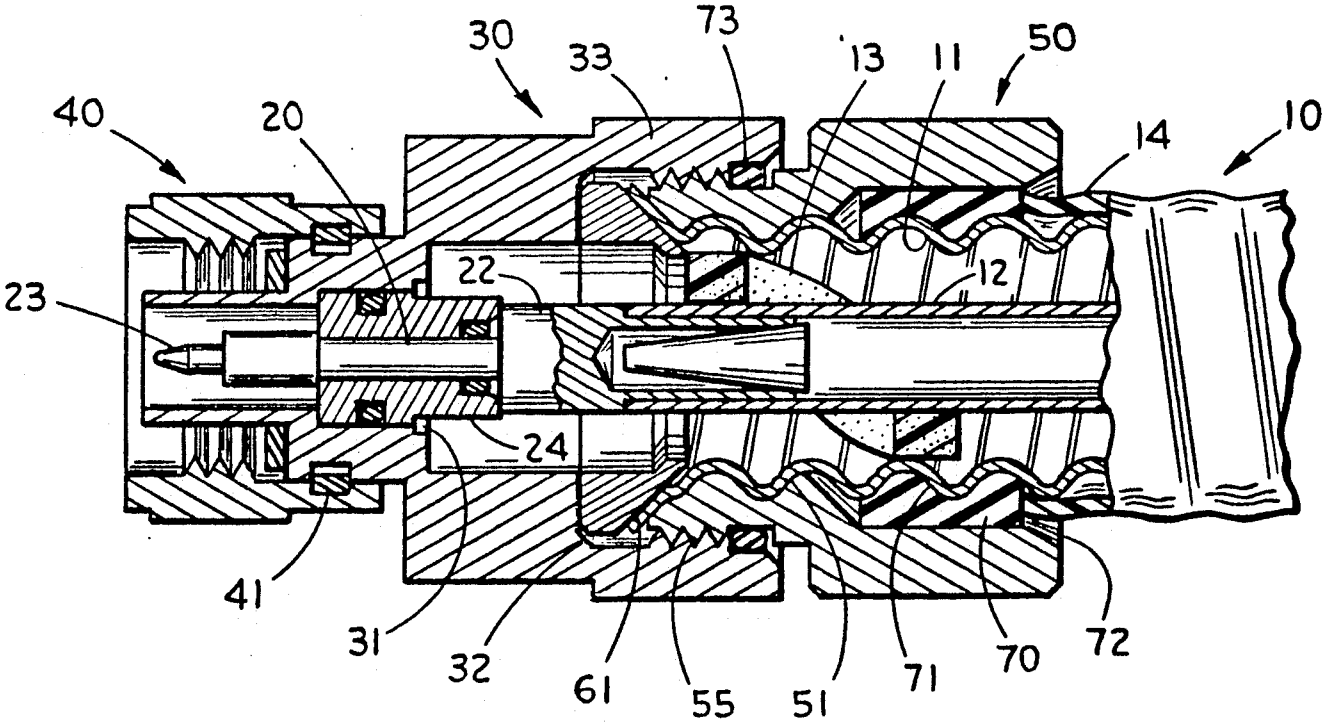
FIG. 3 is a longitudinal sectional view of the connector shown in FIG. 1 with the connector fully assembled.

Turning next to the portion of the connector assembly which makes electrical connection with the inner surface of the outer conductor 11 of the coaxial cable 10, a flaring ring 60 has a conically bevelled surface 61 which matches the bevelled surface 53 on the clamping member 50. The inside diameter of the forward end of the flaring ring is at least as small as the minimum inside diameter of the outer conductor 11, so that the bevelled surface 61 will engage the inner surface of the end portion of the outer conductor around the entire circumference of the cut end. As illustrated in FIG. 2, the bevelled surface 61 acts to flare the end 52 outwardly as the flaring ring is forced into the outer conductor during assembly of the connector, i.e., as the clamping member 50 and the body member 30 are threaded together. Consequently, the connector is self-flaring, and there is no need to manually flare the end of the outer conductor with a pliers. To ease the flaring operation, the surface 61 may be bevelled at more than one angle. For example, the surface 61 may be bevelled at an angle of about 30° at the forward end and about 40° at the rear end, so that the initial flaring action is more gradual than the final flaring action. The optimum angle of the bevelled surface 61 for any given application is dependent on the size of the coaxial cable 10.

Because the inside diameter of the forward end of the flaring ring 60 is smaller than the inside diameter of the outer conductor 14 of the coaxial cable, the flaring ring tends to cause a slight increase in the VSWR of the transmission line. To minimize this effect caused by the forward end of the flaring ring, the inside diameter of the rear portion of the flaring ring is slightly larger than the inside diameter of the outer conductor 11. Moreover, the transition 62 between the two different inside diameters of the flaring ring 60 is located close to the forward end of the flaring ring 60.

The body member 30 includes a recess 32 for receiving the flaring ring during assembly, as shown in FIG. 2. The flaring ring may be formed as an integral part of the body member, rather than as a separate insert, to facilitate handling and installation of the connector assembly, particularly under field conditions where small parts are often dropped and lost.

For the purpose of drawing the flaring ring 60 and the clamping member 50 firmly against opposite sides of the flared end portion of the outer conductor 11, the body member 30 and the clamping member include respective telescoping sleeve portions 33 and 54 with cooperating threaded surfaces 34 and 55, respectively. Thus, when the body member and the clamping member are rotated relative to each other in a first direction, they are advanced toward each other in the axial direction so as to draw the flaring ring 60 and the clamping member 50 into electrically conductive engagement with the outer conductor 11. When the flared end portion of the outer conductor 11 is clamped between the bevelled surface 61 of the flaring ring 60 and the bevelled surface 53 of the clamping member 50, it is also flattened to conform with the planar configuration of the bevelled surfaces 53 and 61. To disengage the connector assembly, the body member 30 and the clamping member 50 are simply rotated relative to each other in the opposite direction to retract the two members away from each other until the threaded surfaces 34 and 55 are disengaged.

To provide a moisture barrier between the inner surface of the clamping member 50 and the outer surface of the outer conductor 11, a gasket 70 is positioned within the cylindrical portion of the clamping member behind the threaded inner surface 51. The gasket 70 has a threaded inner surface 71 to match the helical corrugations of the outer conductor 11. To attach the clamping member 50 to the outer conductor, the clamping member is threaded onto the outer conductor 11 such that the threaded inner surfaces 71 and 51 engage the helical corrugations of the outer conductor. The gasket 70 slightly compresses as it is threaded onto the outer conductor so that the gasket bears firmly against both the outer surface of the conductor 11 and the inner surface of the clamping member 50. The adjacent end portion of the clamping member 50 forms a slightly enlarged recess 72 so that it can fit over the end of the polymeric jacket 14 on the coaxial cable 10, the end of this recess 72 being slightly flared to facilitate entry of the end portion of the jacket 14 into the end of the clamping member 50. A moisture barrier is also provided by an O-ring 73 positioned between the opposed surfaces of the sleeve portions 33 and 54 of the members 30 and 50, respectively.

Figure 5:
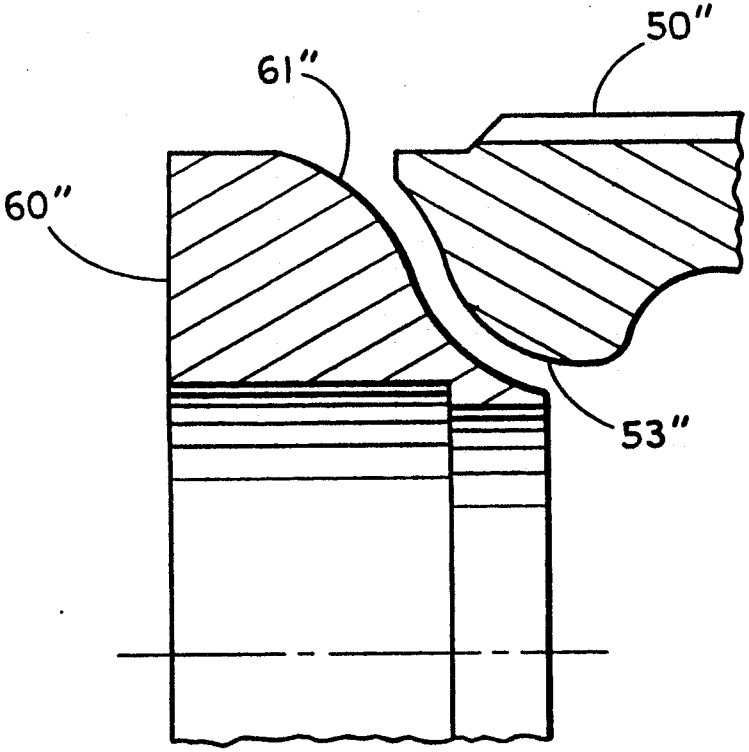
FIG. 5 is a fragmentary longitudinal section of a connector incorporating another modified embodiment of the invention.
Figure 4:
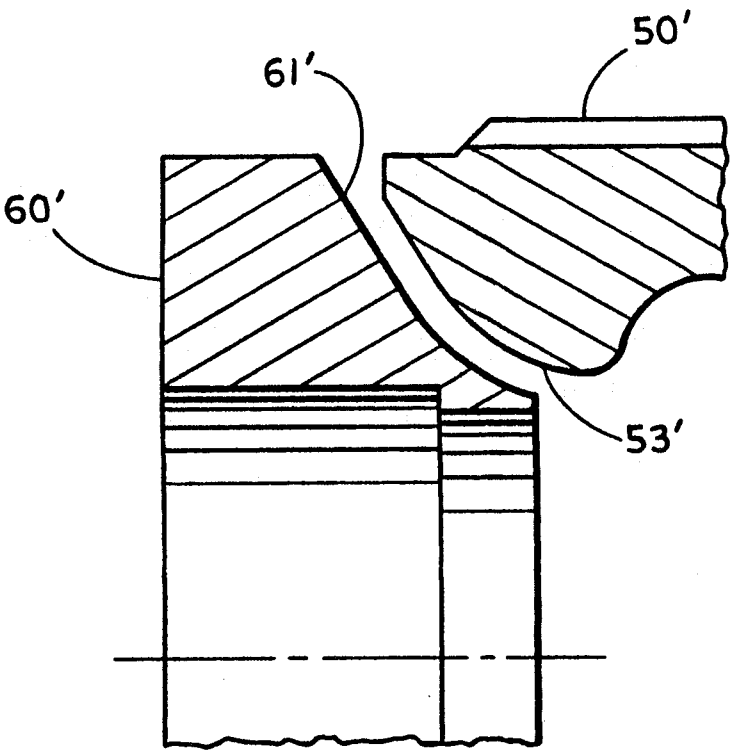
FIG. 4 is a fragmentary longitudinal section of a connector incorporating a modified embodiment of the invention.

FIGS. 4 and 5 illustrate two further variations in the configurations of the bevelled surfaces 53 and 61 on the clamping member 50 and the flaring ring 60, respectively. In the embodiment of FIG. 4, the cooperating bevelled surfaces 53' and 61' form curvilinear surfaces at their inner ends, to initiate a gradual flaring action, and then form flat surfaces at their outer ends. In the embodiment of FIG. 5, the inner portions of the two surfaces 50'' and 61'' are essentially the same as the inner ends of the surfaces 53' and 61' of FIG. 4, but the outer portions of the opposed surfaces curve in the opposite direction so that the most drastic flaring action occurs in the middle portions of the two surfaces 53'' and 61''.

As can be seen from the foregoing detailed description of the illustrative embodiments of the invention, the improved connector assembly is easy to install or reinstall even under adverse field conditions. The connector assembly has a minimum number of parts to minimize the possibility of loss of parts during installation. Moreover, the connector assembly is self-flaring and does not require any preliminary manual flaring operations prior to the installation of the connector assembly. The connector provides positive electrical contact, particularly with the helically corrugated outer conductor, to ensure reliable electrical performance. Furthermore, the connector assembly can be efficiently and economically manufactured.

We claim as our invention:

1. In combination, a connector assembly and a coaxial cable having a helically corrugated outer conductor, the connector assembly comprising:

a unitary clamping member having a threaded inner surface to match helical corrugations of an outer conductor of a coaxial cable so that said clamping member can be threaded onto the helically corrugated outer conductor, an end of said clamping member being beveled so as to slope inwardly toward a threaded inner surface of said clamping member;

a flaring ring having an inside diameter at least as small as an inside diameter of the helically corrugated outer conductor, an end of said ring being bevelled in the same direction as the bevelled end of said clamping member, and wherein the bevelled end of said ring engages an inner surface of an open end of the helically corrugated outer conductor so as to flare the end of the outer conductor outwardly; and a body member having means for drawing and holding the bevelled ends of said flaring ring and said clamping member together against opposite surfaces of the outer conductor of the cable, wherein the helically corrugated outer conductor is not manually flared prior to assembly.

2. The connector assembly of claim 1 which includes an inner conductor and a dielectric spacer which encircles the inner conductor so as to center it respective to the outer conductor.

3. The connector assembly of claim 1 wherein the clamping and body members include integral telescoping sleeves with cooperating threaded surfaces which form said drawing and holding means.

4. The connector assembly of claim 1 wherein said inside diameter of said flaring ring is smaller than the inside diameter of the helically corrugated outer conductor.

5. The connector assembly of claim 1 wherein the inside diameter of the bevelled end of said flaring ring is at least as small as the inside diameter of said outer conductor, and the inside diameter of the other end of the flaring ring is larger than the inside diameter of said outer conductor.

6. The connector assembly of claim 1 wherein the end of the flaring ring opposite the bevelled end of said ring rests on a shoulder formed within said body member.

7. The connector assembly of claim 1 wherein the bevelled end of said flaring ring is bevelled at a shallower angle at the end of the bevel which initially engages said outer conductor than along the remainder of the bevel.

8. The connector assembly of claim 1 wherein the bevelled end of said flaring ring has a curvilinear configuration.

* * * * *